US011745241B2

(12) United States Patent
Meneghello et al.

(10) Patent No.: US 11,745,241 B2
(45) Date of Patent: Sep. 5, 2023

(54) BENDING MACHINE FOR METAL SHEETS WITH A TOOLS' MAGAZINE

(71) Applicant: SALVAGNINI ITALIA S.P.A., Sarego (IT)

(72) Inventors: Roberto Meneghello, Sarego (IT); Giulio Farina, Sarego (IT)

(73) Assignee: SALVAGNINI ITALIA S.P.A., Sarego (IT)

( * ) Notice: Subject to any disclaimer, the term of this patent is extended or adjusted under 35 U.S.C. 154(b) by 80 days.

(21) Appl. No.: 17/275,381

(22) PCT Filed: Oct. 9, 2019

(86) PCT No.: PCT/IB2019/058590
§ 371 (c)(1),
(2) Date: Mar. 11, 2021

(87) PCT Pub. No.: WO2020/075079
PCT Pub. Date: Apr. 16, 2020

(65) Prior Publication Data

US 2022/0048087 A1 Feb. 17, 2022

(30) Foreign Application Priority Data

Oct. 11, 2018 (IT) ..... 102018000009371

(51) Int. Cl.
*B21D 5/02* (2006.01)

(52) U.S. Cl.
CPC ..... *B21D 5/0218* (2013.01); *B21D 5/0227* (2013.01); *B21D 5/0254* (2013.01)

(58) Field of Classification Search
CPC ..... B21D 5/02; B21D 5/0218; B21D 5/0227; B21D 5/0236; B21D 5/0254; B21D 37/14;

(Continued)

(56) References Cited

U.S. PATENT DOCUMENTS 5,134,873 A 8/1992 Miyagawa et al.
5,168,745 A 12/1992 Miyagawa et al.
(Continued)

FOREIGN PATENT DOCUMENTS

CN 103521563 1/2014
CN 104384264 3/2015
(Continued)

OTHER PUBLICATIONS

International Search Report dated Feb. 14, 2020 in International (PCT) Application No. PCT/IB2019/058590.

*Primary Examiner* — Edward T Tolan
(74) *Attorney, Agent, or Firm* — Wenderoth, Lind & Ponack, L.L.P.

(57) ABSTRACT

A bending machine for metal sheets includes a punch arrangement that supports a set of upper bending tools, a die arrangement that supports at least one set of lower bending tools, a tool magazine of bending tools, a replacing apparatus arranged to take bending tools from the tool magazine and mount them on the punch arrangement and/or the die arrangement and vice versa, and a gripping device configured to simultaneously clasp and move a whole set of bending tools. The tool magazine comprises a plurality of supporting guides that house respective sets of bending tools and a transfer carriage arranged to house a set of bending tools and movable between an exchange position to receive from, or provide to, the gripping device a set of bending tools and a plurality of loading positions to transfer to, or receive from, a supporting guide a set of bending tools.

15 Claims, 9 Drawing Sheets

(58) Field of Classification Search
CPC ..... B23Q 2003/15527; B23Q 2003/15528; B23Q 3/15573
See application file for complete search history.

(56) References Cited

U.S. PATENT DOCUMENTS

| | | | | |
|---|---|---|---|---|
| 5,410,904 | A | 5/1995 | Hirata et al. | |
| 5,791,852 | A * | 8/1998 | Bibby | B65G 1/0435 414/280 |
| 6,656,099 | B1 | 12/2003 | Akami et al. | |
| 10,441,986 | B2 | 10/2019 | Lattuada | |
| 10,500,623 | B2 | 12/2019 | Meneghetti | |
| 10,556,262 | B2 * | 2/2020 | Sato | B21D 5/0254 |
| 10,987,715 | B2 * | 4/2021 | Cavicchia | B21D 37/145 |
| 2003/0064871 | A1 | 4/2003 | Akami et al. | |
| 2003/0069114 | A1 | 4/2003 | Akami et al. | |
| 2003/0092547 | A1 | 5/2003 | Akami et al. | |
| 2004/0157715 | A1 | 8/2004 | Akami et al. | |
| 2015/0258594 | A1 | 9/2015 | Sato | |
| 2016/0354821 | A1 | 12/2016 | Meneghetti | |
| 2017/0297073 | A1 | 10/2017 | Sato | |
| 2018/0229286 | A1 | 8/2018 | Sato | |
| 2020/0001340 | A1 * | 1/2020 | Badegruber | B21D 5/0254 |
| 2021/0245226 | A1 * | 8/2021 | Woidasky | B21D 5/0254 |

FOREIGN PATENT DOCUMENTS

| | | |
|---|---|---|
| CN | 105945098 | 9/2016 |
| CN | 106040906 | 10/2016 |
| CN | 106077179 | 11/2016 |
| DE | 200 05 728 | 8/2000 |
| DE | 10 2005 060 763 | 6/2007 |
| EP | 0 392 795 | 10/1990 |
| EP | 0 530 375 | 3/1993 |
| EP | 1 160 024 | 12/2001 |
| EP | 2 913 114 | 9/2015 |
| EP | 3 104 990 | 12/2016 |
| JP | 07-275941 | 10/1995 |
| JP | 2003-136144 | 5/2003 |
| KR | 10-1288254 | 7/2013 |
| WO | 2007/073901 | 7/2007 |
| WO | 2007/073901 | 8/2007 |
| WO | 2016/063579 | 4/2016 |
| WO | 2017/212386 | 12/2017 |

* cited by examiner

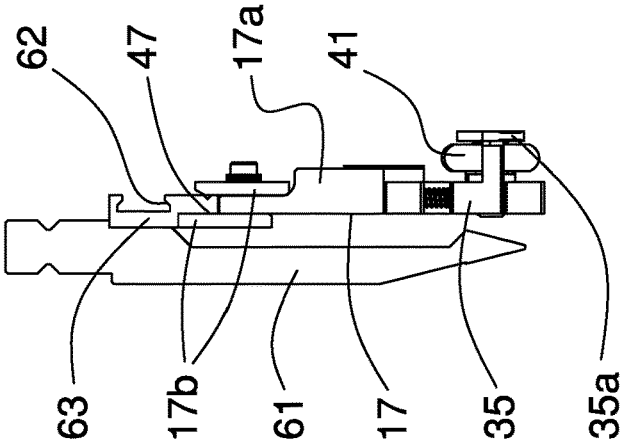
Fig.12
Fig. 5
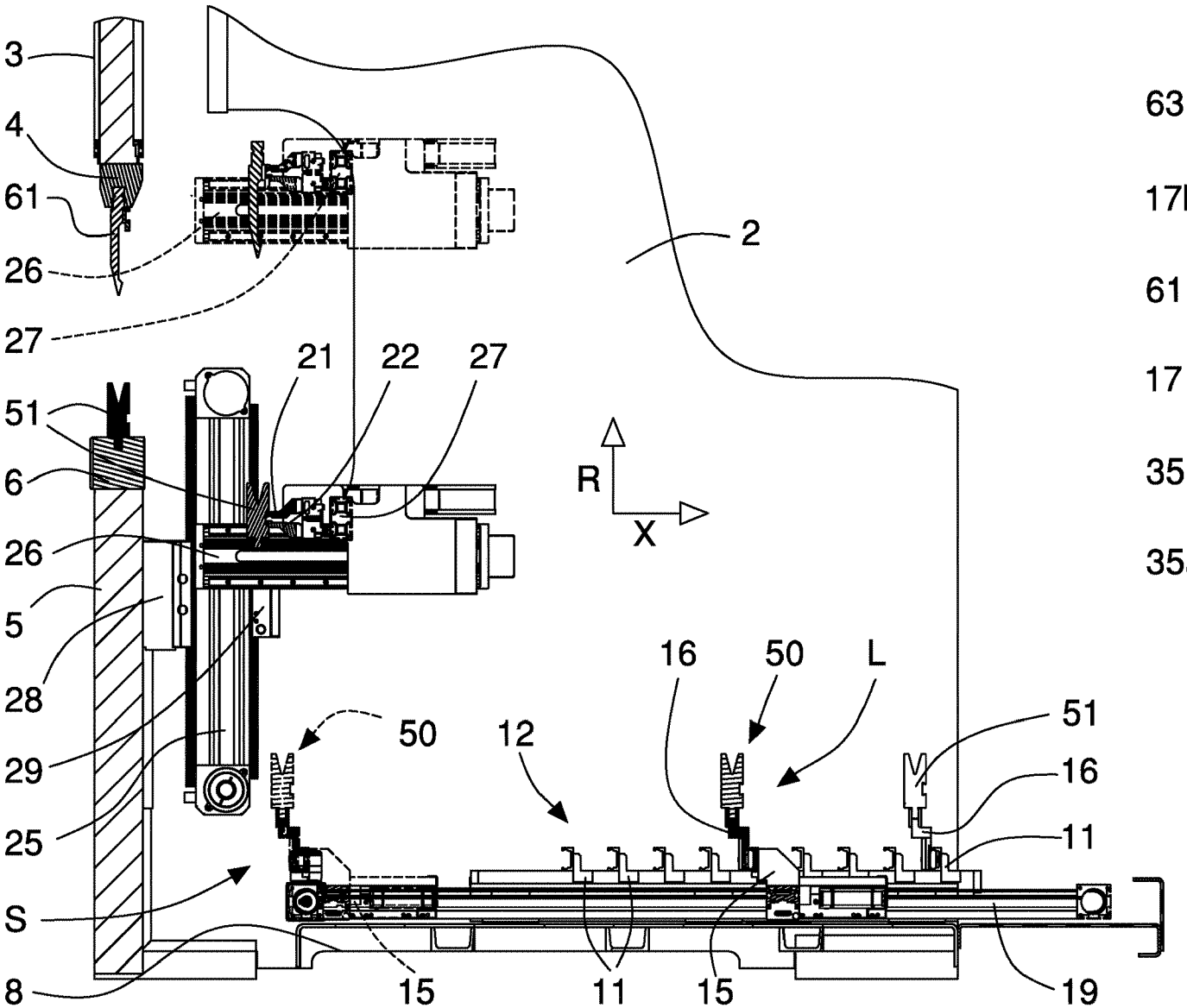

BENDING MACHINE FOR METAL SHEETS WITH A TOOLS' MAGAZINE

The invention relates to bending machines arranged to bend and deform metal tapes, sheets, profiles such as to obtain semi-finished and/or finished products. In particular, the invention relates to a bending machine provided with a tool magazine and a system for replacing bending tools.

They are known bending machines, also called bending presses, comprising a mechanical or hydraulic actuating press capable of moving an upper tool, so called punch, to abut against a lower tool, so called die, onto which the workpiece is placed. The punch exerts a force on the workpiece capable of deforming and bending the latter according to an angle determined by the configuration of the upper and lower tools.

One type of bending machine comprises a punch formed by a blade or bending knife capable of deforming along a predefined bending line the metal workpiece properly positioned on an opposite die provided with a seat or longitudinal groove adapted to interact with the punch so as to bend the workpiece.

The punch is generally formed of a series or set or group of upper bending tools or segments mounted on an upper crosspiece or tool-holding board which moves vertically, so as to form a modular and sectional punch. The number, dimension (width) and position of the upper tools are in fact selected according to the length of the bending to be made and/or to the size of the workpiece, while the type of tool is selected according to the type of bending (angle, shape) to be performed. Similarly, the die can be formed of a series or set or group of lower bending tools or segments mounted on a lower crosspiece or tool-holding board, generally fixed, so as to form a modular and sectional die. The number, dimension (width) and position of the lower tools correspond to number, dimension and position of the upper tools so as to make a desired bending.

In order to carry out a bending of predefined length on the workpiece, it is necessary to choose, within the set of tools mounted on the upper and lower tool-holding boards, adjacent tools having such dimensions (width) as to allow to obtain exactly the required length. As the dimensions of the tools are standardized and vary in a discreet way (typically by 10 mm pitch) according to predefined formats (widths), it is not always possible to achieve the required bendings with the series of tools currently mounted on the crosspiece. In order to carry out subsequent and different working cycles it is often necessary to replace, at least partially, the bending tools mounted on the toll-holding boards.

In case more operations and processing must be performed to obtain the desired product from the initial workpiece (typically manufacturing a panel with bendings from a plane sheet metal) the latter must be transferred in sequence onto several bending machines, for instance arranged into a line.

If the workpiece is small-sized it is possible to perform all operations in a single bending machine, moving the aforesaid piece through subsequent working areas of the machine where bending tools mounted on the same crosspiece carry out the necessary bendings. In this case, the bending tools must be properly selected and arranged along the crosspiece according to the required compositions in the respective working areas so as to carry out subsequent bendings.

In this case also, in order to obtain the different tool compositions required for a working cycle it is necessary to often replace, at least partially, the bending tools mounted on the tool-holding boards.

They are known bending machines provided with tool magazine and systems for replacing bending tools. The aforesaid replacement systems comprise, in particular, gripping and transferring means capable of mounting into the desired positions on the tool-holding boards tools taken from the magazine, and of disassembling from the tool-holding boards tools to be replaced and thus insert them into the magazine.

The tool magazine comprises a plurality of supports or guides adapted to house sets or groups of tools having different dimensions and shapes.

The tool magazine can be external i.e. placed outside the bending machine, typically at a side of the latter, adjacent to a lateral upright of the machine or internal i.e. placed inside the machine, in the space comprised between the two lateral uprights of the machine. In the first case, the external magazine comprises movement means of tool-holding supports and the gripping and transferring means comprise external manipulators as robots, capable of taking the required tools from a support of the magazine, suitably arranged in an exchange position by the moving means, and thus mount them on the (upper and/or lower) tool-holding board or crosspiece and vice versa.

In the second case, the internal magazine comprises tool-holding supports that are generally fixed to inner walls of the upper board and/or of the lower board or of lateral uprights and the gripping and transferring means comprise manipulators or jointed mechanisms which, by way of rotation and/or translation movements, introduce or take one single tool at a time from upper and lower tool-holding boards.

In certain bending machines replacement of upper and/or lower bending tools is performed by regulating devices, provided and used, as known, to arrange and keep the workpiece in the correct position on the die while the bending is performed. Regulating devices can in fact comprise, in addition to abutment elements intended to abut or being abutted by workpieces being transversally and/or longitudinally processed with reference to the bending line, suitable means for gripping bending tools. The regulating devices can in fact be moved at least along two orthogonal directions to position pieces having different shapes and/or dimensions with respect to tools and according to bendings to be made.

They are also known bending machines having inner magazines comprising a plurality of tool-holding supports fixed at a back wall of the machine facing and opposite the upper and lower tool-holding boards.

A disadvantage of the known bending machines provided with external tool-holding magazines, in addition to the cost and complexity, in particular of the moving means of the tool-holding supports and of the means for gripping and transferring tools (outer manipulator), lies in the large dimensions and bulkiness due to the presence of the magazine and manipulator outside the bending machine.

A disadvantage of the known bending machines provided with internal tool-holding magazines lies in the limited and uneasy accessibility to the tool-holding supports placed inside the machine, in particular when fixed to inner walls of tool-holding boards or of lateral uprights, to allow operators to load or unload the set or groups of tools to be used in the processing. Furthermore, for safety reasons, accessibility is not allowed to operators while the bending machine is operating, therefore operations for loading/unloading the magazine tools can only be carried out when the machine is stopped.

Another disadvantage of the known bending machines lies in the systems for replacing tools which enable to replace one tool at a time; the operations for mounting and/or disassembling tools (which must be taken and/or placed back in the magazine) then take a long time during which the bending machine must be stopped, thus interrupting production and reducing productivity thereof.

An object of the present invention is to improve known bending machines provided with tool magazine and systems for replacing bending tools.

Another object is to implement a bending machine provided with tool magazine and an apparatus for replacing tools which enable to replace rapidly and efficiently the bending tools mounted on punch and die, minimizing stopping times.

A further object is to provide a bending machine provided with a tool magazine that can be accessed for loading or unloading sets or groups of bending tools easily, rapidly and safely for operators even when the machine is operating.

Another further object is to implement a bending machine provided with a tool magazine and an apparatus for replacing tools having a simple and compact structure and with efficient and reliable operation.

These and other objects are achieved by a bending machine according to one of the hereinafter reported claims.

The invention will be better understood and implemented referring to the enclosed drawings showing an exemplary and non-limiting embodiment, wherein:

FIG. 5 is a transverse section of the bending machine of FIG. 3;

FIG. 12 is a side view of the second tool-holding carriage of FIG. 11;

Figure 1:
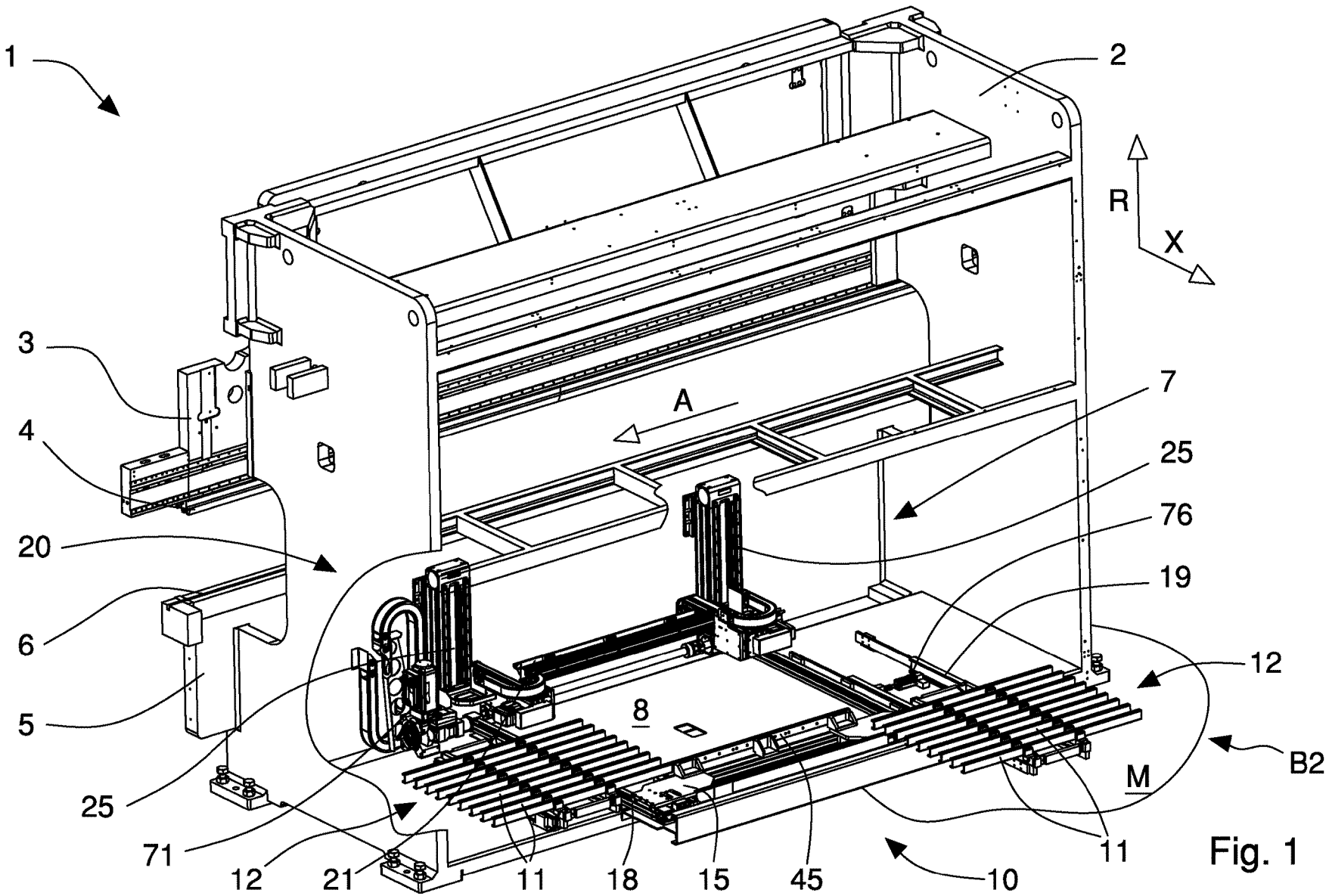
FIG. 1 is a rear perspective, schematic and partially interrupted view of the bending machine of the invention.
Figure 2:
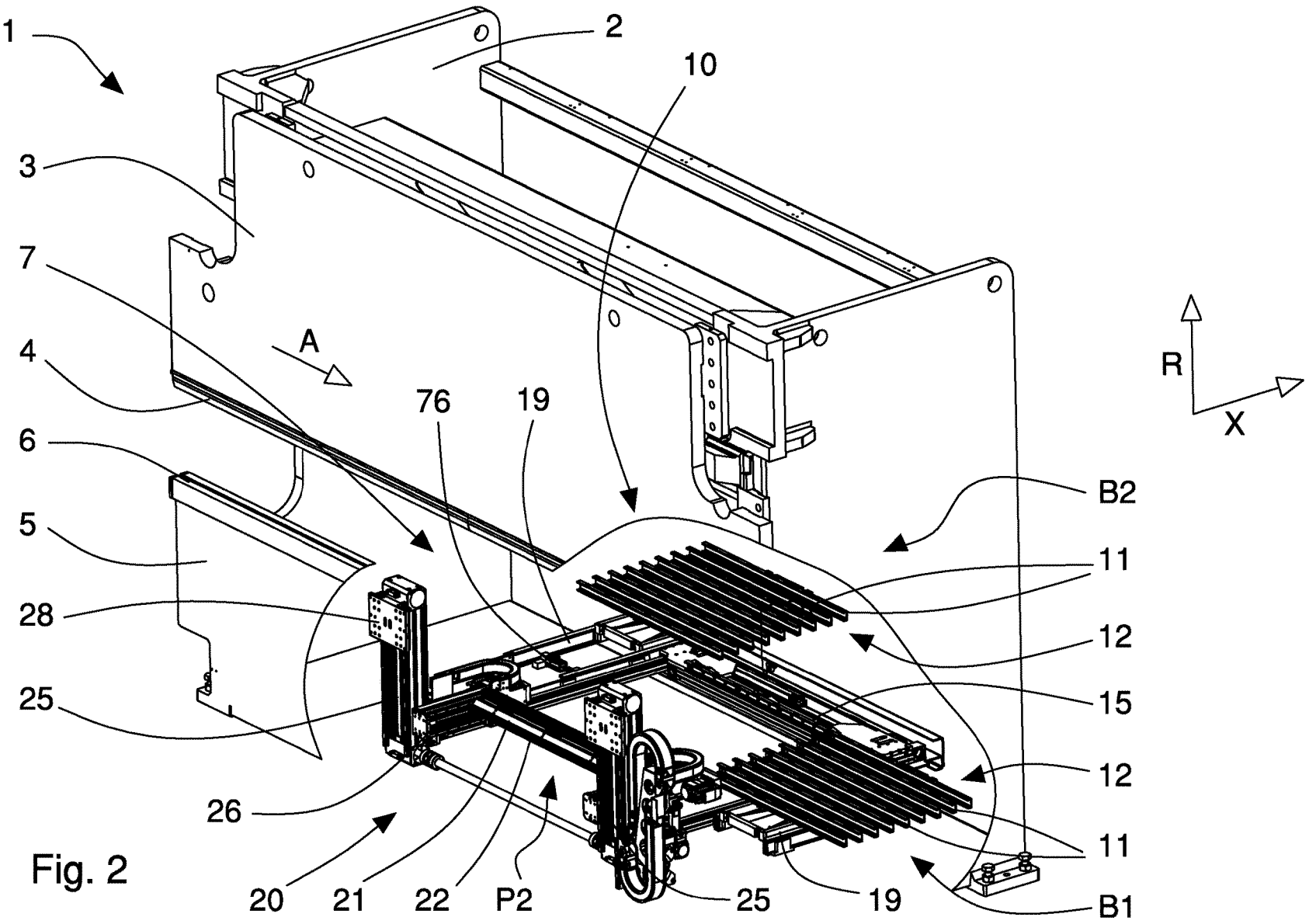
FIG. 2 is a front perspective, schematic and partially interrupted view of the bending machine of the invention of FIG. 1.
Figure 3:
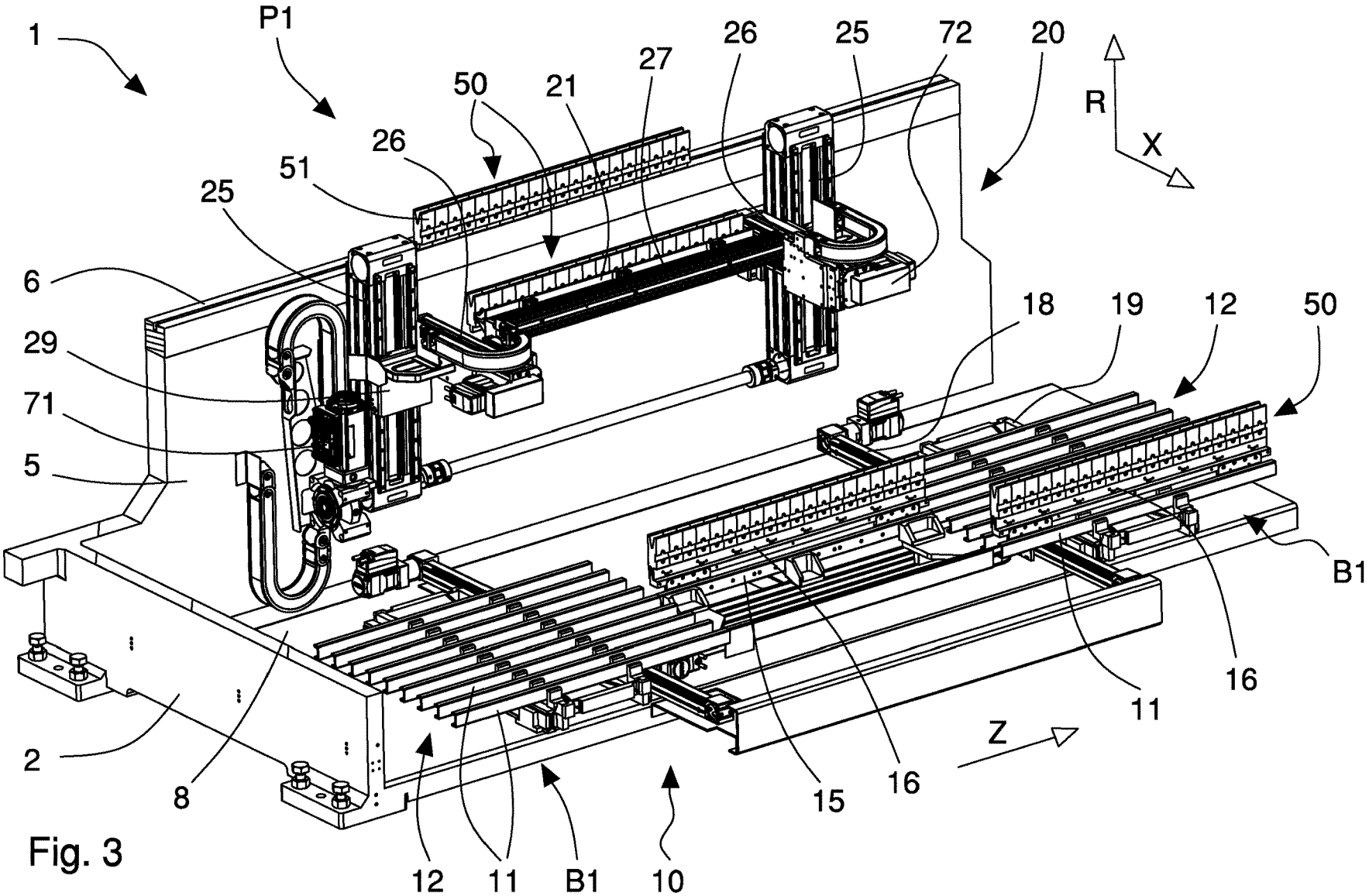
FIG. 3 is a partially perspective and rear view of the bending machine of FIG. 1 wherein some portions were removed to better illustrate a die arrangement, a tool magazine and an apparatus for replacing lower bending tools placed on die arrangement, in a working step.

Referring to FIGS. 1 to 14, it is shown the bending machine 1 for metal sheets according to the invention which comprises a supporting frame 2 to which a punch arrangement 3 and a die arrangement 5 are connected and which comprises a base plate 8 adapted to abut a supporting plane M of a location or place and whereon said bending machine 1 is placed and by which it is supported. The base plate 8, which stands on the supporting plane M, connects at the bottom two external lateral walls of the supporting frame 2. The supporting plane M is a substantially horizontal plane, for example the floor of a place where the bending machine 1 is placed.

The punch arrangement 3 is slidably connected to the supporting frame 2 so as to be movable by known actuating means, not illustrated, along a substantially vertical working direction. The punch arrangement 3 includes an upper crosspiece 4 adapted to house and support at least a series or set or group 60 of upper bending tools, meaning by series a plurality of upper bending tools of a pre-established number. The upper bending tools 61 of an upper bending tools set 60 are mounted on the upper crosspiece 4 aligned along a longitudinal bending direction A, in particular sliding and movable along the upper crosspiece 4. The bending direction A is parallel to the supporting plane M, in particular substantially horizontal. The die arrangement 5 is fixed to the supporting frame 2 and includes a lower crosspiece 6 adapted to support at least a series or set or group 50 of lower bending tools, meaning by series a plurality of lower bending tools of a pre-established number. The lower bending tools 51 of a lower bending tools set 50 are mounted on the lower crosspiece 6 aligned along the bending direction A, in particular sliding and movable along the lower crosspiece 6. In a working configuration of the bending machine 1 the upper crosspiece 4 and the lower crosspiece 6 respectively house a plurality of upper bending tools sets 60, for instance three, and a plurality of lower bending tools sets 50, for instance three. Each of the three bending tools sets 50, 60 comprises a predefined number of tools 51, 61 adapted to form a tool line of predefined length, for example of one metre. Thus, the three upper bending tools sets 60 and lower bending tools sets 50 form on the punch arrangement 3 and on the die arrangement 5, respectively, a complete equipment of bending tools which allow to carry out the required workings on the workpieces. The bending tools 51, 61 are mounted on the respective crosspieces 4, 6 mutually positionable along the bending direction A and allow to form given compositions of bending tools to carry out different workings on a workpiece.

The tools of each bending tools set can be similar to each other, or different in format i.e. they can have different widths so as to obtain, properly grouped and spaced, a plurality of tool compositions.

The upper bending tools 61 and lower bending tools 51 can be moved, singularly or in group, along the respective crosspieces 4, 6 by specific moving means of the bending machine 1.

The upper bending tools 61 can for example be moved by means of a pair of carriages, movable along the upper crosspiece 4 parallely to the bending direction A and provided with respective connecting means to hook a defined upper bending tool so as to move the latter, and other tools adjacent thereto. Such solution is disclosed in EP 3104990 by the same Applicant.

Figure 4:
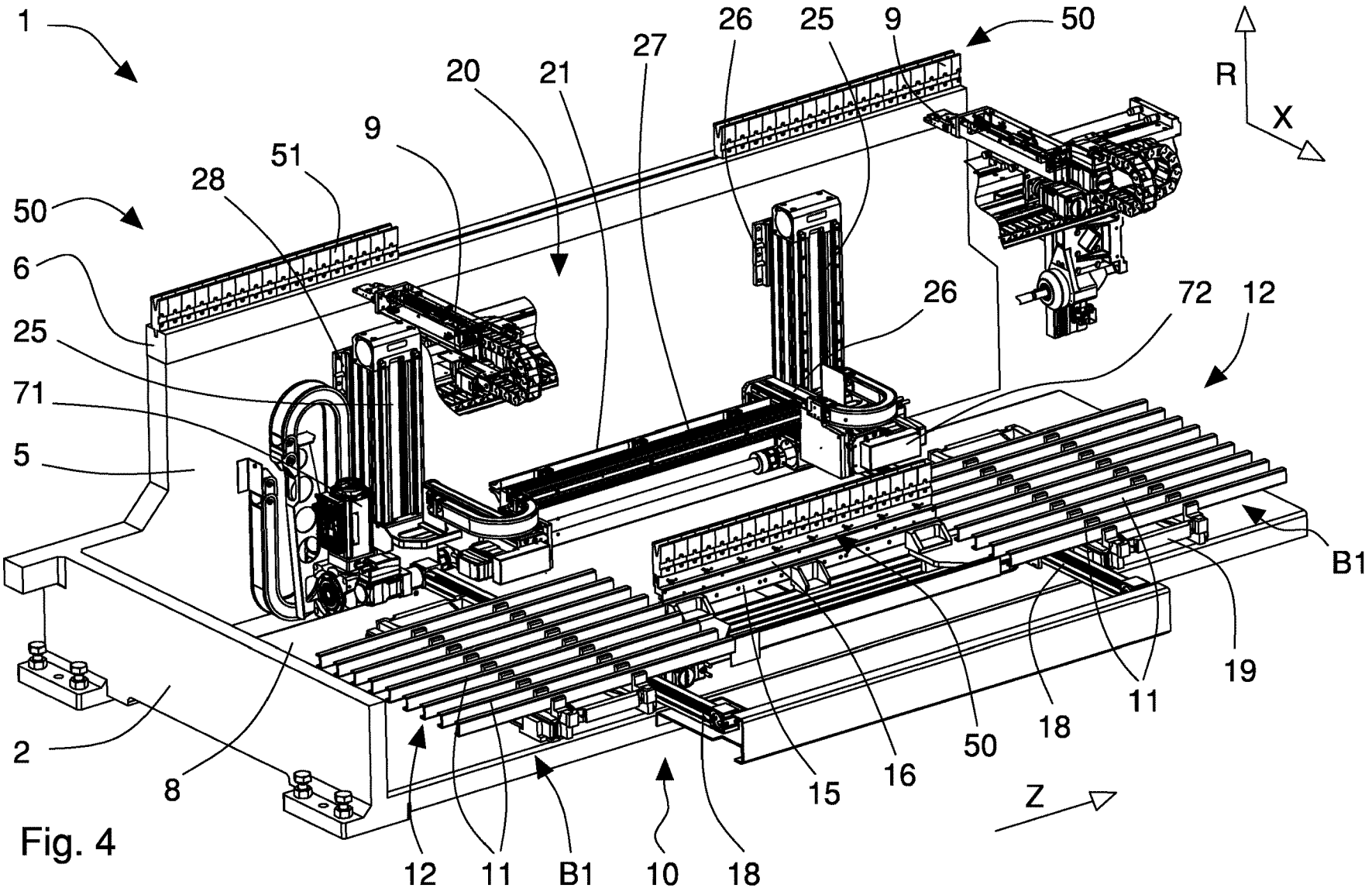
FIG. 4 is a view as that of FIG. 3 which partially illustrates two regulating units of the workpiece cooperating with the replacing apparatus for positioning bending tools on die arrangement.
Figure 6:
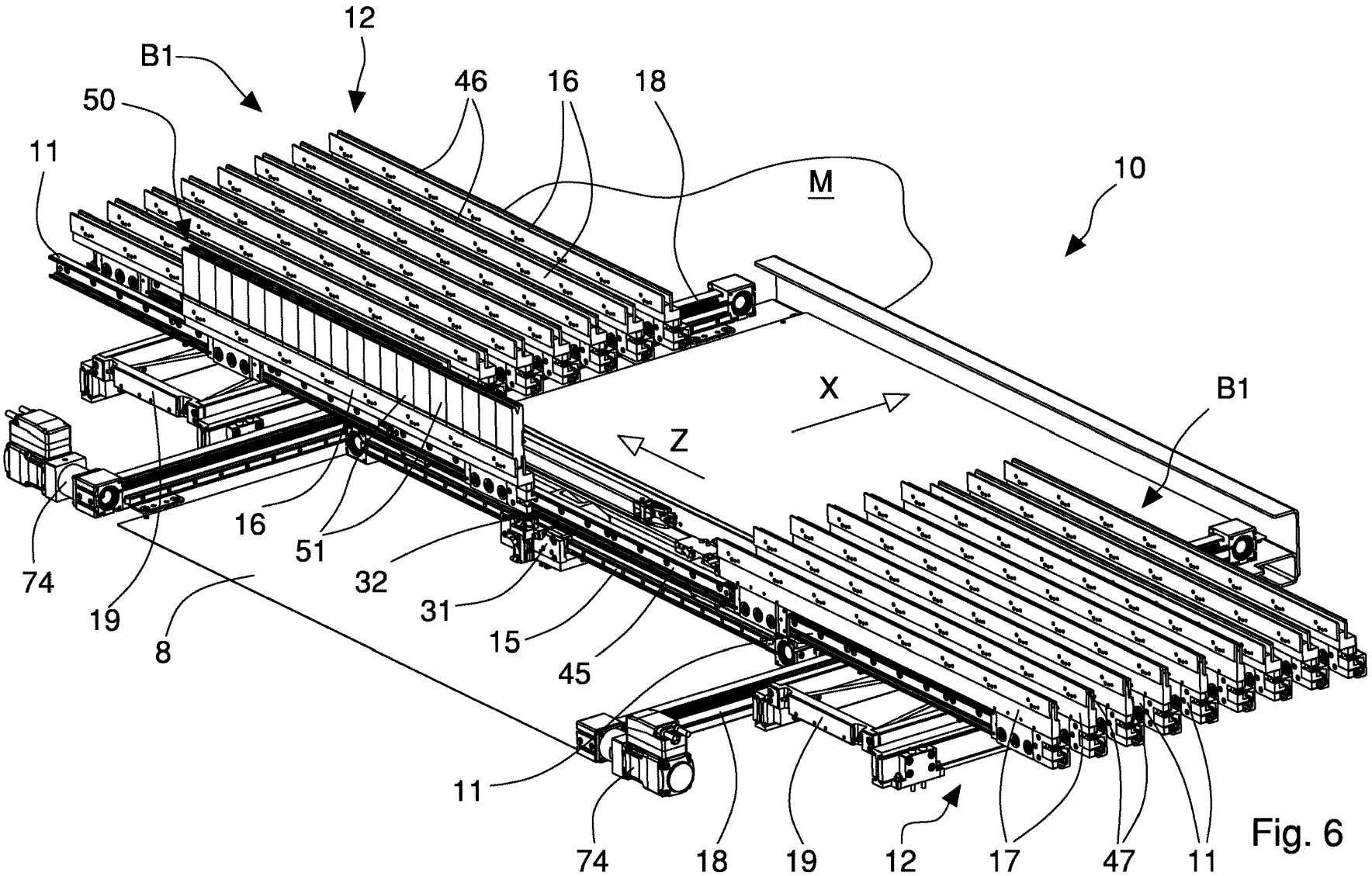
FIG. 6 is a partial perspective and enlarged view of the tool magazine illustrating in particular tool-holding trays supporting a plurality of tool-holding carriages and a transfer carriage.
Figure 7:
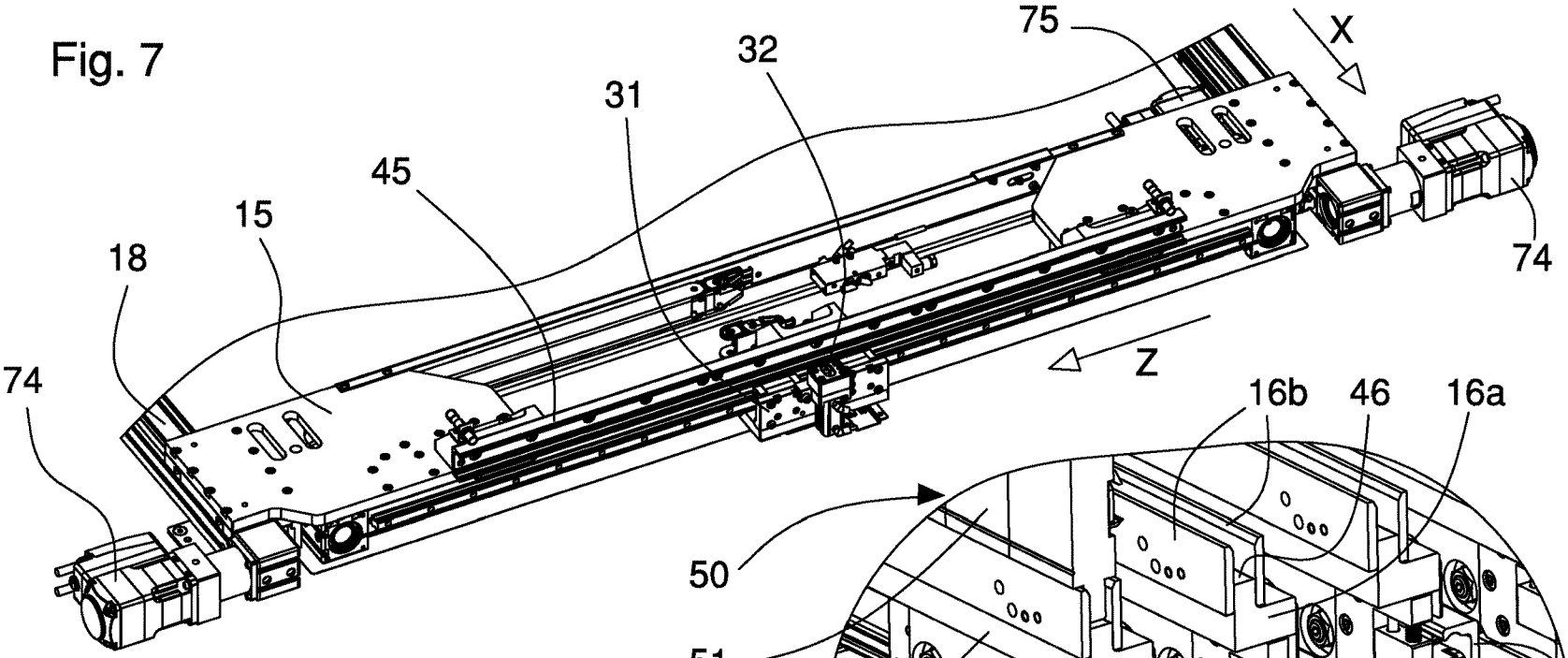
FIG. 7 is a partial perspective and enlarged view of the transfer carriage of the tool-holding magazine.

The lower bending tools 51 are instead movable along the lower crosspiece 6 by a pair of movable regulating units 9 to abut and position a workpiece with respect to the die arrangement 5 and also comprising respective hooking elements to engage at least a lower bending tool 51 so as to move the latter, and other tools adjacent thereto, along the bending direction A on the lower crosspiece 5 (FIG. 4).

The bending machine 1 of the invention includes a tool magazine 10 which is positioned in an internal compartment 7, defined by the supporting frame 2, the punch arrangement 3 and the die arrangement 5, and it is arranged to house bending tools 51, 61. The bending machine 1 also includes a replacing apparatus 20, also positioned in the internal compartment 7 and arranged to take bending tools 51, 61 from the tool magazine 10 and mount them on the punch arrangement 3 and/or on the die arrangement 5 and vice versa, i.e. to disassemble bending tools 51, 61 from the punch arrangement 3 and/or the die arrangement 5 and transfer them to the tool magazine 10.

The replacing apparatus 20 comprises a gripping device 21, 22 configured to hook and support at the same time a bending tools whole set 50, 60. The replacing apparatus 20 also comprises an actuating assembly 25, 26, 27, 28, 29 to support and move the gripping device 21, 22 in the internal compartment 7 between a first gripping position P1 and a second gripping position P2. In the first gripping position P1 the gripping device 21, 22 is capable of taking from, or transferring to the punch arrangement 3 and/or die arrangement 5, a bending tools whole set 50, 60; in the second gripping position P2, the gripping device 21, 22 is capable of transferring on, or taking from the tool magazine 10 a bending tools whole set 50, 60.

The actuating assembly 25, 26, 27, 28, 29 is arranged to move the gripping device 21, 22 along a first driving direction X, substantially orthogonal to the bending direction A and parallel to the supporting plane M, and a second driving direction R, substantially orthogonal to the first driving direction X and to the bending direction A. The actuating assembly 25, 26, 27, 28, 29 comprises at least an upright 25 which slidably supports an arm 26, which is movable along the second driving direction R and arranged to slidably support a supporting crosspiece 27, the latter being movable along the first driving direction X and supporting the gripping device 21, 22.

The upright 25 is furthermore slidably fixed to the supporting frame 2, in particular to the die arrangement 5, and is movable along the second driving direction R.

In the embodiment illustrated in the figures, the actuating assembly 25, 26, 27, 28, 29 comprises a pair of uprights 25 parallel between them and slidably supporting respective arms 26 that slidably support the supporting crosspiece 27. The two uprights 25 are mounted substantially symmetrical with respect to a centre plane of the bending machine 1 and are slidably fixed to an internal wall of the die arrangement 5 by respective first translation carriages 28 so as to be movable along the second driving direction R. The two arms 26 are slidably mounted to the respective uprights 25 by means of second translation carriages 29.

First actuating means 71 are provided to move the two uprights 25 with respect to the first translation carriages 28, fixed to the supporting frame 2, and concurrently the second translation carriages 29, with the arms 26 fixed thereto, along the upright 25 with an overall telescopic-type movement of the arms 26 along the second driving direction R.

The first actuating means 71 comprise, for example, an electric motor arranged to actuate, by means of pulleys and toothed belts, the first and second translation carriages 28, 29 so as to move the uprights 25 and arms 26 along the second driving direction R.

Second actuating means 72 are provided on each arm 26 to move the supporting crosspiece 27, slidably mounted on the arms 26 and supporting the gripping device 21, 22, along the first driving direction X.

The second actuating means 72 comprise, for example, a pair of electrical motors each of which is associated to an arm 26 for moving, for example by way of a toothed belt, or similar, supported by pulleys, an end of the supporting crosspiece 27. The two electrical motors of the second actuating means 72 are controlled so as to move the supporting crosspiece 27 along the first driving direction X parallelly to the bending direction A.

In a variant of the bending machine 1 not illustrated in the figures, the second actuating means 72 can comprise a single electrical motor mounted on one of the two arms 26 to move the supporting crosspiece 27, for example by means of a toothed belt supported by pulleys.

The gripping device 21, 22 comprises a pair of gripping elements 21, 22 movable and arranged to engage and lock in a gripping configuration P all the hooking seats 52, 62 of the bending tools 51, 61 of a bending tools set 50, 60.

Figure 13:
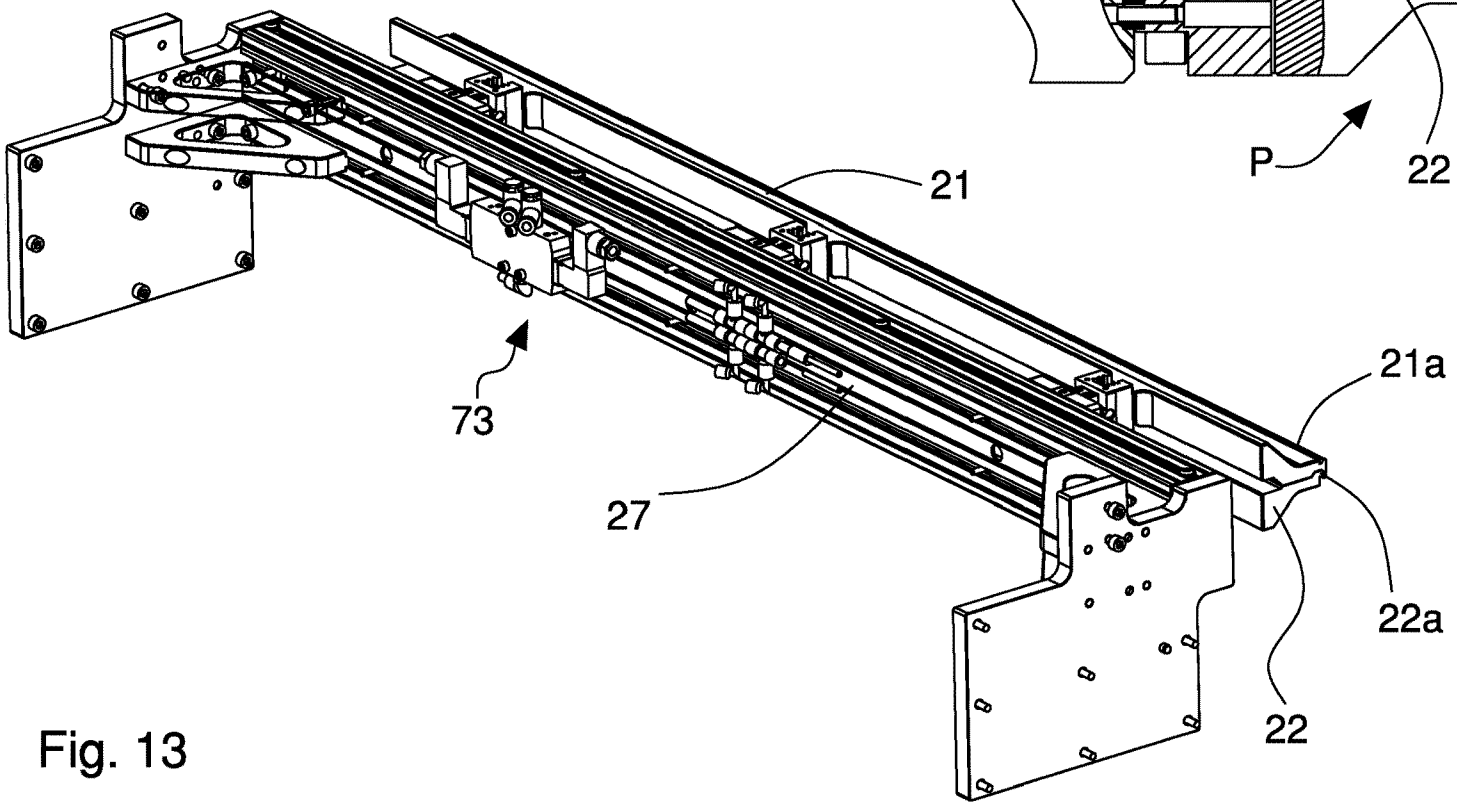
FIG. 13 is a perspective view of a gripping device of the replacing apparatus arranged in a closed inserting/releasing configuration.

As illustrated in FIG. 13, the gripping elements 21, 22 are elements extended along the bending direction A and having length corresponding to that of a bending tools set 50, 60.

The gripping elements 21, 22 have respective shaped ends 21*a*, 22*a* adapted to fit into all hooking seats 52, 62 of the bending tools of a bending tools set 50, 60 in a closed inserting configuration and thus engage and lock to the hooking seats 52, 62 in an open gripping configuration P to enable gripping and thus lifting and transferring the bending tools whole set 50, 60.

The gripping device 21, 22 is moved between the closed inserting configuration and the open gripping configuration P, i.e. mutually departing or approaching, by third actuating means 73 of the known type and not illustrated in detail. In particular, the third actuating means 73 move the two gripping elements 21, 22 linearly approaching or departing along a direction that is substantially parallel to the second driving direction R.

Figure 10:
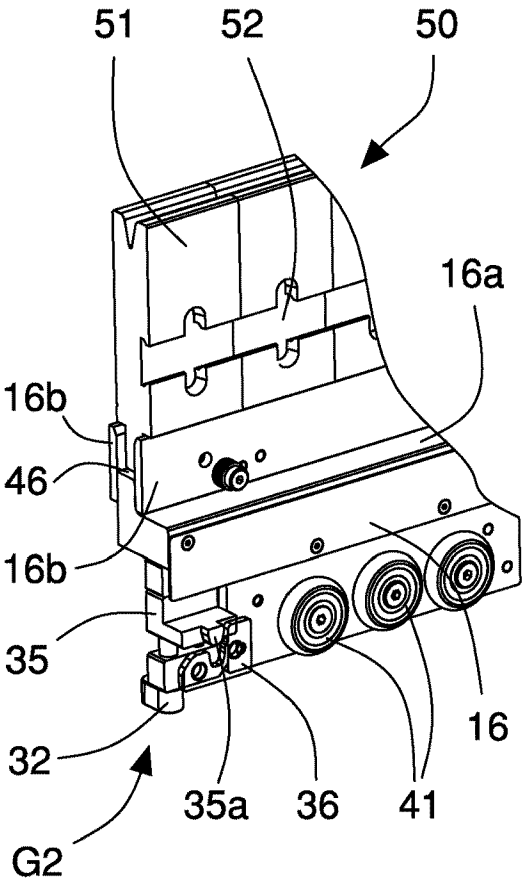
FIGS. 9 and 10 are enlarged and partial perspective views of a first tool-holding carriage housing a lower bending tools set, with hooking means respectively in a releasing position and in a hooking position.
Figure 9:
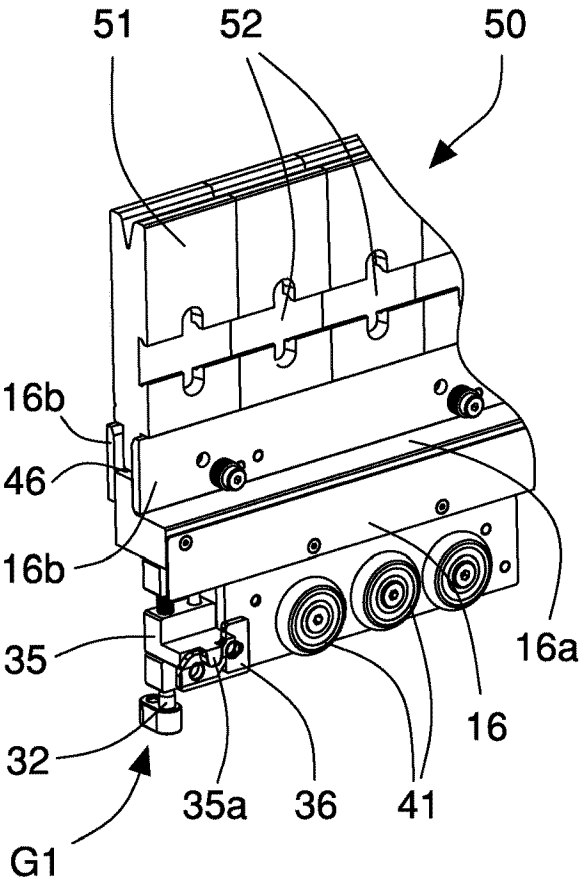
Figure 14:
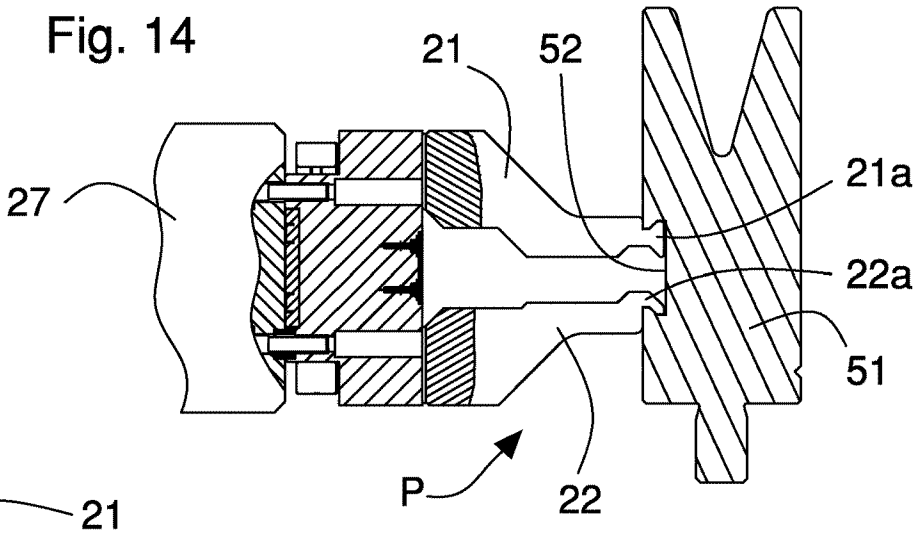
FIG. 14 is a partial section of gripping device of FIG. 13 associated to a lower bending tools set and in an open gripping position.

Each lower bending tool 51 is provided with a respective first hooking seat 52 which comprises a corresponding shaped cavity implemented on the internal flank (i.e. directed towards the internal compartment 7) of the tool body, as illustrated in FIGS. 9 and 10. In alternative, the first hooking seat 42 of each lower bending tool 51 can be made on a connecting element fixed to the tool internal flank.

Figure 11:
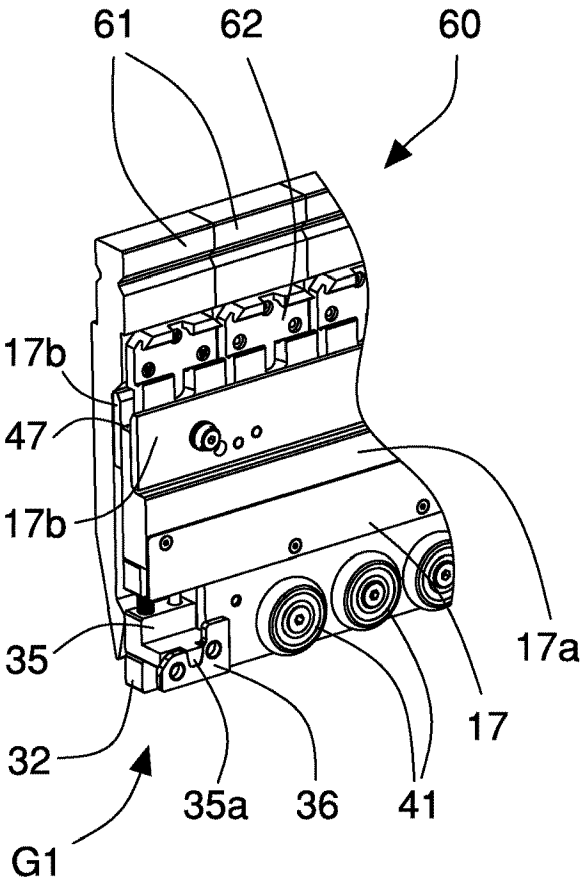
FIG. 11 is an enlarged and partial view of a second tool-holding carriage housing higher bending tools, with hooking means in a releasing position.

Each upper bending tool 61 is provided with a respective second hooking seat 62 which comprises a corresponding shaped cavity made on a connecting element 63 fixed on the internal flank (i.e. directed towards the internal compartment 7) of the tool, as illustrated in FIG. 11.

The tool magazine 10 comprises a plurality of supporting guides 11 adjacent to, and supported by, the base plate 8, arranged adjacent between them and parallel to the bending direction A (and to the supporting plane M) and adapted to slidably house a respective bending tools set 50, 60. The tool magazine 10 further comprises a transfer carriage 15, adjacent to, and supported by, the base plate 8, and movable along the first driving direction X between an exchange position S, in which the transfer carriage 15 is adjacent to the replacing apparatus 20 to receive from, or provide to the gripping device 21, 22 a bending tools set 50, 60 and a plurality of loading positions L, in each of which the transfer carriage 15 is aligned to a respective supporting guide 11 in order to transfer to, or receive from said supporting guide 11 a bending tools set 50, 60, by moving the latter along a movement direction Z parallel to the bending direction A.

The transfer carriage 15 is slidably supported at opposite ends by a pair of supporting guides 18 fixed to the base plate 8 of the supporting frame 2 and arranged parallel between them and to the first driving direction X.

Fourth actuating means 74 are provided to move the transfer carriage 15 along the supporting guides 18. The fourth actuating means 74 comprise, for example a pair of electrical motors each of which is associated to a supporting guide 18 to move, by means of a toothed belt and respective pulleys, an end of the transfer carriage 15. The two electric motors of the fourth actuating means 74 are controlled so as to move the transfer carriage 15 along the first driving direction X.

The tool magazine 10 comprises at least a tool-holding tray 12 arranged to support a plurality of supporting guides 11, positioned adjacent and parallel to the bending direction A and the supporting plane M, and slidably connected to, and supported by the base plate 8 of the supporting frame 2. The tool-holding tray 12 is movable along the first driving direction X between an operating position B1, in which it is completely inside the bending machine 1, in the internal compartment 7, to enable the supporting guides 11 to receive from, or provide to the transfer carriage 15 respective sets of bending tools 51, 61, and a non-operating position B2, in which the tool-holding tray 11 is outside the bending machine 1 and the internal compartment 7 to enable an operator, for example, to insert bending tools sets 50, 60 into, or remove them from the supporting guides 11. In particular, the tool-holding tray 12 is slidably connected to the base plate 8 by means of a supporting frame 19, for example of the telescopic type and extensible towards the outside in the non-operating position B2. In the embodiment illustrated in the figures, the tool-holding tray 12 is ejected i.e. moved in the non-operating position B2, manually, after de-actuating a stopping unit 76, comprising for example a pneumatic roll, which locks the tool-holding tray 12 in the operating position B1.

In one variant of the packaging machine 1, not illustrated, the tool-holding tray 12 is moved between the operating position B1 and the non-operating position B2 by respective actuating means, for example comprising pneumatic linear actuators.

In the embodiment illustrated in the figures, the tool magazine 10 comprises a pair of tool-holding trays 12 slidably connected to and supported by the base plate 8 of the supporting frame 2 at opposite sides of the transfer carriage 15, each tool-holding tray 12 supporting a plurality of supporting guides 11 and being slidably connected to the base plate 8 by means of a respective supporting frame 19 to be movable between the respective operating position B1 and non-operating position B2.

The tool magazine 10 further comprises one or more first tool-holding carriages 16 each of which is provided with a first longitudinal seat 46 arranged to receive and support a lower bending tools set 50 and one or more second tool-holding carriages 17, each of which is provided with a second longitudinal seat 47 arranged to receive and support a respective upper bending tools set 60. More precisely, each first tool-holding carriage 16 comprises a first elongated body 16*a* provided with two parallel and spaced first slats 16*b* which form the first longitudinal seat 46, substantially corresponding to the seat provided on the lower crosspiece 6, so as to fixedly and firmly house a lower bending tools set 60. Similarly, each second tool-holding carriage 17 comprises a second elongated body 17*a* provided with two parallel and spaced second slats 17*b* which form the second longitudinal seat 47 capable of fixedly and firmly receiving the connecting elements 63 fixed to the flanks of the upper bending tools 61.

The tool-holding carriages 16, 17 can be slidably housed in the transfer carriage 15 and in any one of the supporting guides 11, movable along the movement direction Z. More precisely, the first and second tool-holding carriages 16, 17 are for example of the same number as supporting guides 11 and in an operating configuration of the bending machine 1 illustrated by way of example in FIG. 6, each sliding guide 11 supports a respective tool-holding carriage 16, 17 which can in turn support a respective lower or upper bending tools set 50, 60. In particular, a tool-holding tray 12 (the one placed on the right of the transfer carriage 15 referring to views of FIGS. 4 and 5) comprises a plurality of supporting guides 11 to which respective first tool-holding carriages 16 intended to receive relative lower bending tools sets 50 are associated. The remaining tool-holding tray 12 comprises a plurality of supporting guides 11 to which respective second tool-holding carriages 17 intended to receive relative upper bending tools sets 60 are associated.

Each tool-holding carriage 16, 17 has an elongated-shaped body, provided at opposite ends with a plurality of wheels 41 intended to slidably engage with the supporting guides 11 or with a rail 45 mounted on the transfer carriage 15. The rail 45 and the supporting guides 11 are in fact shaped so as to allow to move the tool-holding carriage 16, 17 along the movement direction Z, parallel to the bending direction A, to transfer each tool-holding carriage 16, 17 from the transfer carriage 15 to the supporting guides 11 and vice versa, and avoid on the contrary displacements along directions that are orthogonal to the aforesaid bending direction A, for example along the first driving direction X.

As better explained in the hereinafter description, the first and second tool-holding carriages 16, 17 are advantageously employed to transfer the bending tools set 50, 60 from the supporting guides 11 of the tool-holding trays 12 to the transfer carriage 15 and vice versa, so as to allow easy replacement of bending tools whole sets 50, 60 mounted on the punch arrangement 3 and on the die arrangement 5 of the bending machine 1.

For this purpose, the transfer carriage 15 comprises a moving assembly 31 and a hooking element 32 arranged to hook and move on a supporting guide 11 a tool-holding carriage 16, 17 which is housed on the transfer carriage 15 or to hook a tool-holding carriage 16, 17 housed in a supporting guide 11 and move and transfer it on the transfer carriage 15. In detail, the moving assembly 31 comprises a moving slide 31 movable on the transfer carriage 15 along the movement direction Z. The moving slide 31 is actuated along the transfer carriage 15 by fifth actuating means 75 comprising an electric motor adapted to move the aforesaid moving slide 31 by means of a belt supported by pulleys.

The hooking element 32 is supported by the moving slide 31 and can be actuated between a releasing configuration G1 and a hooking configuration G2. In the hooking configuration G2 the hooking element 32 engages the tool-holding carriage 16, 17 to connect it to the moving slide 31 so as to move it with the latter along the movement direction Z. In the releasing configuration G1 the hooking element 32 is on the contrary disengaged from the tool-holding carriage 16, 17.

The hooking element comprises, in particular, a hooking pin 32 moved by a linear actuator 33 between the hooking configuration G2 and the releasing configuration G1. In the hooking configuration G2, the hooking pin 32 engages in a complimentary-shape cavity provided on each tool-holding carriage 16, 17. The linear actuator 33, for example of the pneumatic type, is fixed to the moving slide 31.

Figure 8:
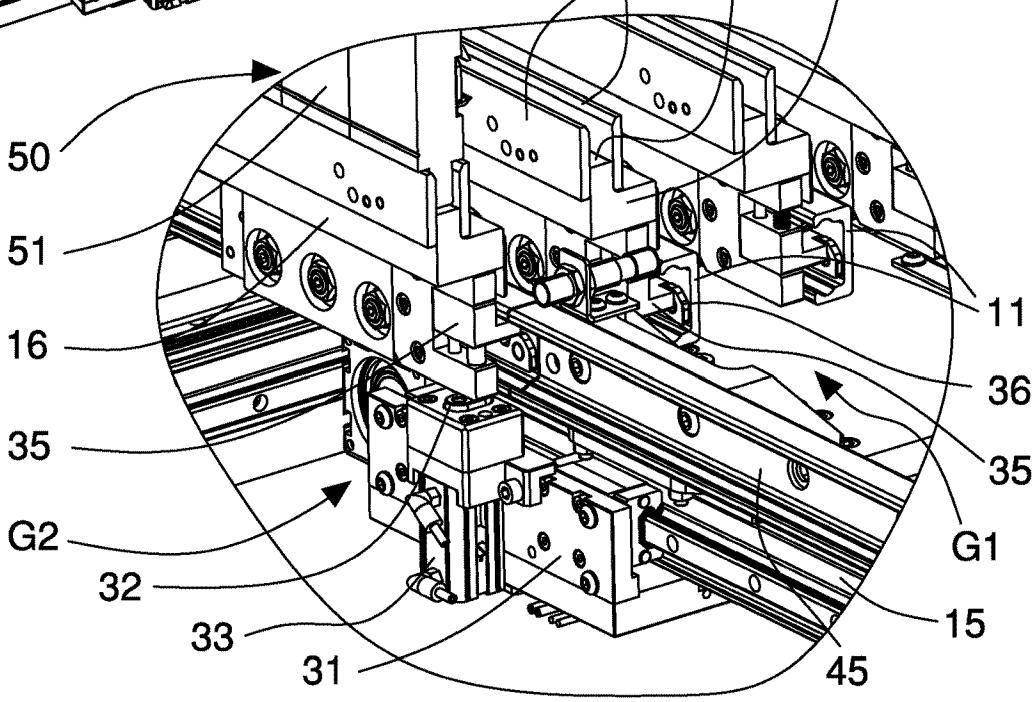
FIG. 8 is a partial perspective and enlarged view of a detail of the tool magazine of FIG. 6 which illustrates movement means of the transfer carriage and locking elements of tool-holding carriages.

Each tool-holding carriage 16, 17 comprises a respective movable first locking element 35 to engage or disengage a respective second locking element 36 provided on each of the supporting guide 11 so as to fasten or unfasten the tool-holding carriage 16, 17 to/from a supporting guide 11 on which it is positioned. The first locking element 35 of a tool-holding carriage 16, 17 is driven by the hooking means 32 of the transfer carriage 15, when operated in the hooking configuration G2, in order to disengage second locking element 36 of a supporting guide 11 on which the aforesaid tool-holding carriage is positioned 16, 17. Referring in particular to FIGS. 8 to 10, the first locking element 35 of each tool-holding carriage 16, 17 comprise a locking member 35 slidably fixed to an end and lower portion of the tool-holding carriage, at the wheels 41. The locking member 35, movable along a substantially vertical direction, comprises a stopping tooth 35*a* intended to engage with a complimentary-shape recess of the second locking element 36. This latter comprises a locking plate 36 fixed inside each sliding guide 11 and provided with the recess, as illustrated in FIGS. 8-11. The locking member 35 is kept in a locking position (that is pushed vertically downwards), wherein it engages with the recess of the second locking element 36, by elastic means fixed to the end and lower portion of the tool-holding carriage 16, 17. Thereby, in a storage configuration, in which the tool-holding carriages 16, 17 are housed in the respective supporting guides 11 they are also locked to the latter and unable to move.

The locking member 35 is moved (vertically upwards) in an unfastening position, wherein it is disengaged from the recess of the locking plate 36, from the hooking pin 32 of the transfer carriage 15.

The operation of the tool magazine 10 and of the replacement apparatus 20 of the bending machine 1 of the invention provides, in a procedure for mounting on the die arrangement 5 a whole equipment of lower bending tools 50 (for instance formed by three lower bending tools sets 50), to identify a first established lower bending tools set 50 positioned on the respective first tool-holding carriage 16 housed in an established sliding guide 11 of the tool-holding tray 12 and to move the transfer carriage 15 such that it is aligned along the moving direction 12 and to move the transfer carriage 15 such that it is aligned along the movement direction Z to the aforesaid sliding guide 11 in a respective loading position L. Thereby the hooking means 32 of the transfer carriage 15 are capable of hooking, in the hooking configuration G2, the first tool-holding carriage 16 housed in the aforesaid established sliding guide 11. By actuating the movement slide 31 it is thus possible to move the first tool-holding carriage 16 and transfer it from the sliding guide 11 to the transfer carriage 15. The latter is then moved by fourth actuating means 74 along the first driving direction X from the loading position L to the exchange position S in which the gripping device 21, 22 of the replacement apparatus 20 is arranged by the actuating assembly 25-29 in the second gripping position P2 to take from the first tool-holding carriage 16, supported by the transfer carriage 15, the lower bending tools whole set 50. Such operation is carried out by inserting the shaped ends 21*a*, 22*a* of the gripping elements 21, 22 arranged in a closed inserting configuration inside the first hooking seats 52 of the lower bending tools 51 of the lower bending tools set 50 housed in the first tool-holding carriage 16.

The gripping device 21, 22 is then moved by the third actuating means 73 in the open gripping configuration P so as to engage and fasten the first hooking seats 52 of the lower bending tools 51. The gripping device 21, 22 can thus be moved by actuating assembly 25-29 in the first gripping position P1 along the first and second driving direction X, R so as to extract from the transfer carriage 15 the lower bending tools set 50 and thus position it and release it on the lower crosspiece 6 of the die arrangement 5 in central position, i.e. at a central portion of the lower crosspiece 6 passed through by a centre plane of the bending machine 1.

Such operating mounting sequence is repeated for a second lower bending tools set 50 placed on a respective first tool-holding carriage 16 taken from a respective sliding guide 11 of the tool-holding carriage 12 by the transfer carriage 15 aligned to the aforesaid sliding guide 11 in a corresponding loading position L. The lower bending tools second set 50 is thus positioned and released by gripping device 21, 22 of the replacement apparatus 20 on the lower crosspiece 6 in central position. In the meantime, the previous lower bending tools first set 50 already released on the lower crosspiece 6 has been moved along the latter by one of the regulating units 9 and placed at an end portion of the aforesaid lower crosspiece 6 in order to release its central portion.

Similarly, the operating mounting sequence is repeated for a bending tools third set 51 which is taken from the tool magazine 10 and arranged on the lower crosspiece 6 to form a complete equipment of lower bending tools 51 which enables the bending machine 1 to perform a plurality of workings on the workpieces.

A mounting operating sequence that is substantially identical to the above described one is carried out to mount three upper bending tools sets 60, taken from respective tool-holding carriages 17 housed in corresponding supporting guides 11 of the tool magazine 10, on the upper crosspiece 4 of the punch arrangement 3.

The procedure for disassembling or replacing a lower bending tools set 50 or upper bending tools set 60 provides to carry out backwardly the above described steps for the mounting procedure. In this case, the transfer carriage 15, arranged in the exchange position S, supports a tool-holding carriage 16, 17 that is empty and capable of receiving a bending tools set 50, 60 taken by the gripping device 21, 22 of the replacement apparatus 20 from the lower crosspiece 6 or from the upper crosspiece 4. Subsequently, the transfer carriage 15 is moved along the first driving direction X at a prefixed sliding guide 11, that is empty and adapted to receive the tool-holding carriage 16, 17 and the relative bending tools set 50, 60.

By means of the bending machine 1 of the invention it is thus possible to replace rapidly and efficiently the bending tools 51, 61 mounted on the punch arrangement 3 and die arrangement 5, minimizing machine stopping times.

The replacing apparatus 20 and the tool magazine 10 in fact allow for replacing in a single operation a lower or upper bending tools whole set, three bending tools sets 50, 60 forming on the lower crosspiece 6 and upper crosspiece 4 respective complete equipment of bending tools which enable to carry out specific bendings on the workpiece (with established bending shape, angle and geometry) having continuously variable lengths with a definite pitch starting from minimum value. As bending tools 51, 61 are mounted on the respective crosspieces 6, 4 that are mutually positionable along the bending direction A and can be separated and grouped, they allow to form all the bending tools compositions required to perform different workings on a workpiece.

The replacement of the sets of tools mounted on the punch arrangement 3 and die arrangement 5 with other sets 50, 60 of tools that are housed in the supporting guides 11 of the tool magazine 10 is therefore rapid, said sets of tools being arranged to carry out bendings having different bending shapes and/or geometries on workpieces. Thanks to the tool-holding trays 12 of the magazine 10, movable along the first driving direction X in the non-operating position B2 outside the bending machine 1 and the internal compartment 7, it is further possible to easily, rapidly and safely insert or remove from the supporting guides 11 the bending tools sets 50, 60, to prepare the machine for future workings. Such operation can be carried out safely by an operator even when the bending machine 1 of the invention is operating, with no need therefore to stop the latter and to the benefit of productivity.

Finally, it is worth noting that the gripping device 21, 22 and actuating arrangement 25-29 of the replacing apparatus 20 allow to grip and move precisely and reliably the sets of tools and have, likewise the tool magazine 10, a simple and compact structure as well as efficient and reliable operation.

The invention claimed is:

1. A bending machine for metal sheets, the bending machine comprising:

a supporting frame provided with a base plate adapted to abut a supporting plane whereon the bending machine is placed;

a punch arrangement that includes an upper crosspiece adapted to support at least one set of upper bending tools, the upper bending tools being aligned along a bending direction parallel to the supporting plane;

a die arrangement that includes a lower crosspiece adapted to support at least one set of lower bending tools, the lower bending tools being aligned along the bending direction;

a tool magazine positioned in an internal compartment defined by said supporting frame, said punch arrangement and said die arrangement, and arranged to house bending tools;

a replacing apparatus positioned in the internal compartment and arranged to take bending tools from said tool magazine and mount said bending tools on said punch arrangement and/or said die arrangement and remove bending tools from said punch arrangement and/or said die arrangement and transfer said bending tools to said tool magazine, wherein said replacing apparatus comprises a gripping device configured to simultaneously hook and move a whole set of said bending tools, said tool magazine comprises a plurality of supporting guides adjacent to, and supported by, said base plate, which are arranged parallel to the bending direction and adapted to each slidably house a respective set of bending tools, and a transfer carriage adjacent to, and supported by, said base plate, and adapted to house a set of bending tools, said transfer carriage is movable along a first driving direction, orthogonal to the bending direction and parallel to the supporting plane, between an exchange position, in which said transfer carriage is adjacent to said replacing apparatus in order to receive from, or provide to, said gripping device a set of bending tools, and a plurality of loading positions in each of which said transfer carriage is aligned to a respective one of said supporting guides in order to transfer to, or receive from, said respective supporting guide a set of bending tools, by moving said respective supporting guide along a movement direction parallel to the bending direction.

2. The bending machine according to claim 1, wherein said upper crosspiece and said lower crosspiece in a working configuration of the bending machine respectively comprise a plurality of sets of upper bending tools and a plurality of sets of lower bending tools, and said upper bending tools of said plurality of sets of upper bending tools are mounted on said upper crosspiece and said lower bending tools of said plurality of sets of lower bending tools are mounted on said lower crosspiece to be mutually positionable along the bending direction in order to form given compositions of bending tools to carry out respective workings on workpieces.

3. The bending machine according to claim 1, wherein said replacing apparatus further comprises an actuating assembly for supporting and moving said gripping device in the internal compartment between a first gripping position, in which said gripping device takes from, or transfers to, said punch arrangement and/or said die arrangement a set of bending tools, and a second gripping position, in which said gripping device transfers to, or takes from, said transfer carriage a set of bending tools.

4. The bending machine according to claim 3, wherein said actuating assembly is arranged to move said gripping device at least along the first driving direction and along a second driving direction substantially orthogonal to the first driving direction and to the bending direction.

5. The bending machine according to claim 4, wherein said actuating assembly comprises at least one upright slidably supporting an arm that is movable along the second driving direction and slidably supports a supporting crosspiece, and said supporting crosspiece is movable along the first driving direction and supports said gripping device.

6. The bending machine according to claim 5, wherein said upright is slidably fixed to said supporting frame and is movable along the second driving direction.

7. The bending machine according to claim 5, wherein said actuating assembly comprises a pair of uprights that are parallel and slidably support respective arms, said arms supporting said supporting crosspiece.

8. The bending machine according to claim 1, wherein said gripping device comprises a pair of gripping elements that are movable and arranged to engage and lock in a gripping configuration all hooking seats of said bending tools of said whole set of bending tools.

9. The bending machine according to claim 1, wherein said tool magazine further comprises at least one tool-holding tray that is arranged to support said plurality of supporting guides, slidably connected to, and supported by, said base plate and movable along the first driving direction between an operating position, in which said tool-holding tray is completely inside the bending machine in the internal compartment in order to enable said supporting guides to receive from, or provide to, said transfer carriage respective sets of bending tools, and an non-operating position, in which said tool-holding tray is outside the bending machine and the internal compartment in order to enable inserting in, or removing from, said supporting guides respective bending tools sets.

10. The bending machine according to claim 9, wherein said tool magazine further comprises a pair of tool-holding trays each of which supports a respective plurality of supporting guides, said tool-holding trays being slidably connected to, and supported by, said base plate at opposite sides of said transfer carriage.

11. The bending machine according to claim 1, wherein said tool magazine further comprises at least one first tool-holding carriage provided with a first longitudinal seat arranged to receive and support a set of lower bending tools, and at least one second tool-holding carriage provided with a second longitudinal seat arranged to receive and support a set of upper bending tools, wherein said first and second tool-holding carriages can be slidably housed in said transfer carriage and in any one of said supporting guides, movable along the movement direction.

12. The bending machine according to claim 11, wherein said transfer carriage comprises a moving assembly for hooking a tool-holding carriage housed on said transfer carriage and moving said tool-holding carriage in a supporting guide, or hooking a tool-holding carriage housed in a supporting guide and moving said tool-holding carriage on said transfer carriage.

13. The bending machine according to claim 12, wherein said moving assembly comprises a moving slide movable on said transfer carriage along the movement direction, and a hooking element fixed to said moving slide and driveable between a hooking configuration, in which said hooking element engages said tool-holding carriage in order to connect said tool-holding carriage to said moving slide, and a releasing configuration, in which said hooking element is disengaged from said tool-holding carriage.

14. The bending machine according to claim 11, wherein each tool-holding carriage comprises a respective movable first locking element for engaging or disengaging a respective second locking element of one of said supporting guides in order to respectively fasten or unfasten said tool-holding carriage to/from a supporting guide on which said tool-holding carriage is positioned.

15. The bending machine according to claim 14, wherein said transfer carriage comprises a moving assembly for hooking a tool-holding carriage, said moving assembly comprises a moving slide movable on said transfer carriage along the movement direction, and a hooking element fixed to said moving slide and driveable between a hooking configuration, in which said hooking element engages said tool-holding carriage in order to connect said tool-holding carriage to said moving slide, and a releasing configuration, in which said hooking element is disengaged from said tool-holding carriage, and said movable first locking element of said tool-holding carriage is driven by said hooking element of said transfer carriage, operated in the hooking configuration, in order to disengage a second locking element of a supporting guide on which said tool-holding carriage is positioned.

* * * * *